US007308986B2

(12) United States Patent
Tank et al.

(10) Patent No.: US 7,308,986 B2
(45) Date of Patent: Dec. 18, 2007

(54) COLLECTION CASE

(75) Inventors: Scott Tank, Hudson, WI (US); Michael Nicholas Ermolovich, Willow Grove, PA (US)

(73) Assignee: St. Croix Trading & Collectibles, Inc., Hudson, WI (US)

( * ) Notice: Subject to any disclaimer, the term of this patent is extended or adjusted under 35 U.S.C. 154(b) by 192 days.

(21) Appl. No.: 11/351,726

(22) Filed: Feb. 10, 2006

(65) Prior Publication Data

US 2006/0124475 A1 Jun. 15, 2006

Related U.S. Application Data

(63) Continuation of application No. 10/917,613, filed on Aug. 13, 2004, now abandoned, which is a continuation of application No. 10/213,249, filed on Aug. 5, 2002, now Pat. No. 6,827,209.

(60) Provisional application No. 60/324,005, filed on Sep. 21, 2001.

(51) Int. Cl.
*B65D 85/00* (2006.01)

(52) U.S. Cl. ..... 206/732; 206/232; 206/449; 206/459.5

(58) Field of Classification Search ..... 40/661; 53/428; 150/145, 147; 206/37, 38, 315.1, 206/449–451, 453–455; 283/109, 112
See application file for complete search history.

(56) References Cited

U.S. PATENT DOCUMENTS

| | | | | | |
|---|---|---|---|---|---|
| 4,979,619 | A * | 12/1990 | Hager | 206/509 |
| 5,040,671 | A * | 8/1991 | Hager | 206/39 |
| 5,249,383 | A * | 10/1993 | McCusker et al. | 40/654.01 |
| 5,306,049 | A * | 4/1994 | Schireck | 283/74 |
| 6,142,532 | A * | 11/2000 | Gluck | 283/75 |
| 6,149,003 | A * | 11/2000 | Day | 206/449 |
| 6,220,441 | B1 * | 4/2001 | Cook | 206/579 |
| 6,295,750 | B1 * | 10/2001 | Harwell et al. | 40/661 |
| 6,475,634 | B1 * | 11/2002 | Lam | 428/542.4 |
| 6,827,209 | B1 * | 12/2004 | Tank et al. | 206/232 |
| 2003/0033745 | A1 * | 2/2003 | Ribaudo | 40/800 |

* cited by examiner

*Primary Examiner*—Mickey Yu
*Assistant Examiner*—Jerrold Johnson
(74) *Attorney, Agent, or Firm*—Skadden, Arps, Slate, Meagher & Flom LLP

(57) ABSTRACT

A collection case combines a trading card with an actual piece of associated memorabilia to enhance its value. The collection case encapsulates the two items together in a protective plastic slab for safe keeping. The process results in a new collectable product of increased value.

4 Claims, 3 Drawing Sheets

COLLECTION CASE

CROSS-REFERENCE TO RELATED APPLICATIONS AND PRIORITY CLAIM

This application is a continuation of U.S. patent application Ser. No. 10/917,613 filed Aug. 13, 2004 (now abandoned), which is a continuation of U.S. patent application Ser. No. 10/213,249 filed Aug. 5, 2002 (now U.S. Pat. No. 6,827,209), which claims the benefit, under 35 U.S.C. §119, of U.S. Provisional Application No. 60/324,005, entitled "Graded, Game-Used Memorabilia," filed Sep. 21, 2001 (expired), all of which are incorporated herein by reference.

BACKGROUND OF THE INVENTION

The present invention relates to collectable memorabilia. More particularly, the invention relates to collectable trading cards.

Trading cards are very popular collectable items for the sports and entertainment industries. Trading cards are often produced for baseball, hockey, basketball, football, soccer, golf, auto racing, comic characters, entertainers, and the like. A typical trading card has a photograph or image of a personality or character on a first side of the trading card, and related statistics, biographical information, or the like on the reverse side.

Collecting trading cards has been an American hobby for over 100 years. For many, the thrill of collecting trading cards is also financially rewarding. The value of a trading card may vary greatly, depending on the rareness and condition of the trading card. Rare, old cards can be extremely valuable. For example, an original Honus Wagner trading card in good condition from the 1909 through 1911 T206 Tobacco Set was recently sold at auctioned for over $1 million.

Due to their value, trading cards have become a significant "for profit" business. A large service industry has arisen around trading cards, offering services such as preserving and grading cards. The grading process includes determining a trading card's overall condition. Criteria used in evaluating condition typically include image centering, card cut, corner conditions, edging, surface condition, such as scratches or stains, post-production trimming, creases or folds in the card, and the like. To preserve the trading card's condition, it is often put in a "slab." "Slabbing" a the term used to describe the process of encapsulating a card after its condition has been determined. Typically, a trading card is sonically sealed in a hard acrylic case and assigned a bar code for registration purposes.

Collectors and enthusiasts also purchase game, or event, specific memorabilia, such as game-used: bats, balls, jerseys, uniforms, flags, artificial turf, stadium equipment, hockey sticks, pucks, tickets, gloves, auto part, instruments, and the like. Dealers sell these items at high costs to the consumer, thereby limiting the availability of such whole memorabilia to the average collector or enthusiast. Accordingly, some dealers divide up the whole memorabilia and sell individual pieces of such memorabilia. For example, a dealer may cut up a game used bat to sell individual miniature bats.

Gluck discloses a memorabilia package in U.S. Pat. No. 6,142,532. The disclosed memorabilia card consists of a photograph with a piece of game, or event, memorabilia adhered to the surface of the photograph. The piece of memorabilia is mounted and positioned on the photograph where he image of the memorabilia appears in the photograph. For example, a piece of memorabilia such as a miniature bat manufactured from a game-used bat, would be mounted on a photograph of a batter in the location where the image of the bat would normally appear in the photograph. Unfortunately, mounting a piece of memorabilia to the memorabilia card diminishes any "collector's" value the card has, in and or itself. Thus, the value of the package is typically limited to the value of the specific piece of memorabilia itself.

It is desirable to provide collectors with a collection case that enhances the combined value of its individual components. Additionally, the desired collection case would be protected from damage.

BRIEF SUMMARY OF THE INVENTION

In one embodiment of the invention a graded trading card is combined with an actual piece of associated memorabilia to enhance its value. The two items are encapsulated together in a protective plastic slab for safekeeping. This process results in a new collection case of increased value.

DETAILED DESCRIPTION OF THE INVENTION

Figure 1:
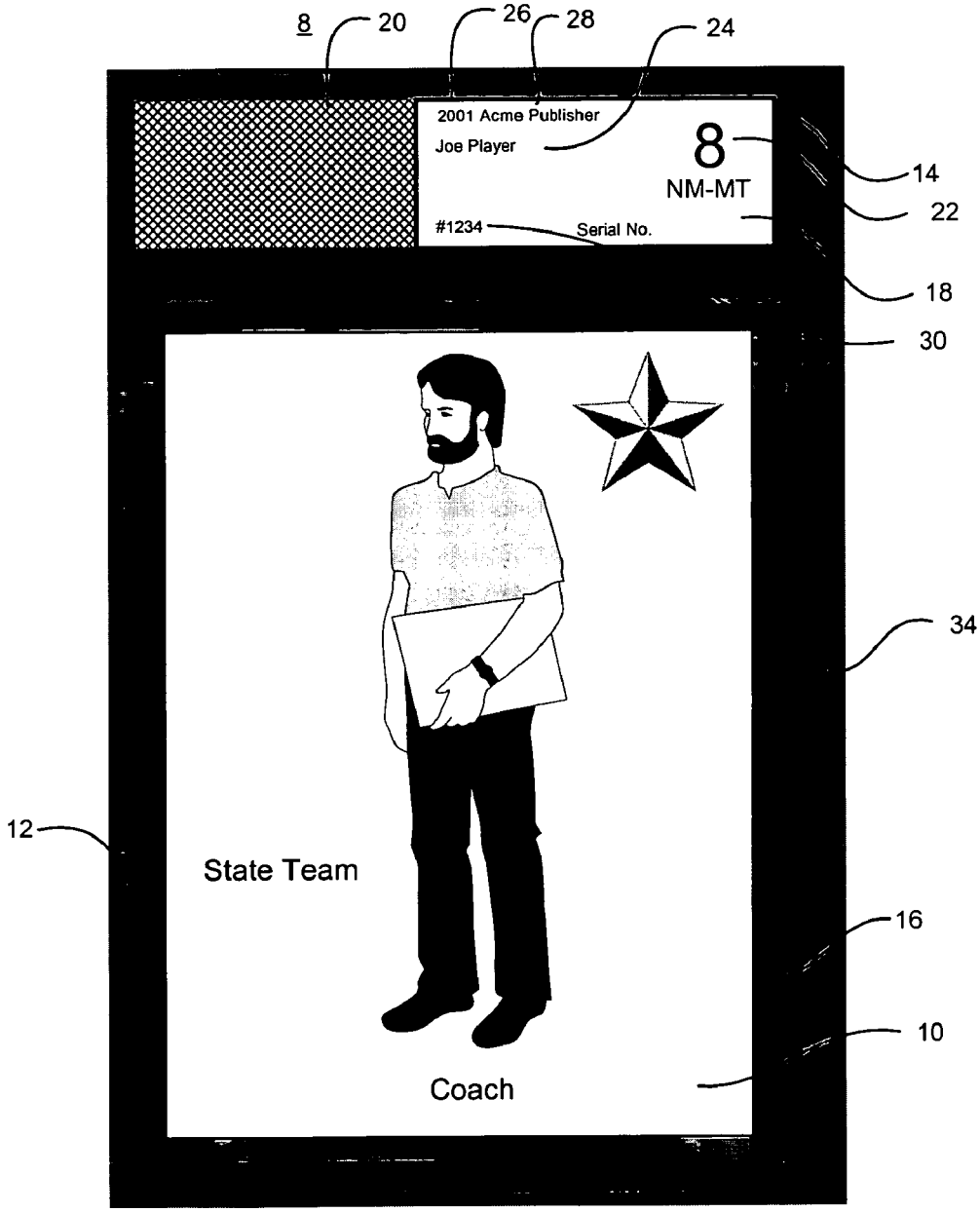
FIG. 1 illustrates front view of an embodiment of the front of a of memorabilia article in accordance with the invention.

FIG. 1 illustrates a front view of a collection case 8 according to an embodiment of the invention. A trading card 10 is shown encapsulated in a case 12. The internal cavity of the case is divided into an upper portion 14 and a lower portion 16. The trading card 10 is housed in the lower portion 16. The upper portion 14 contains a piece of associated memorabilia 20. Preferably, the associated memorabilia 20 is a piece of a game or event specific memorabilia. In one embodiment, upper portion 14 includes a grading report 18. The grading report 18 contains such items as the card's overall grade 22, the card's subject matter 24, the card's publishing year 26, the publisher 28, the series number 30, a brief description of the piece of memorabilia 20, and the like. In one embodiment, the report 18 is color-coded according to the grade of the card 10. In another embodiment, the trading card is ungraded.

Figure 2:
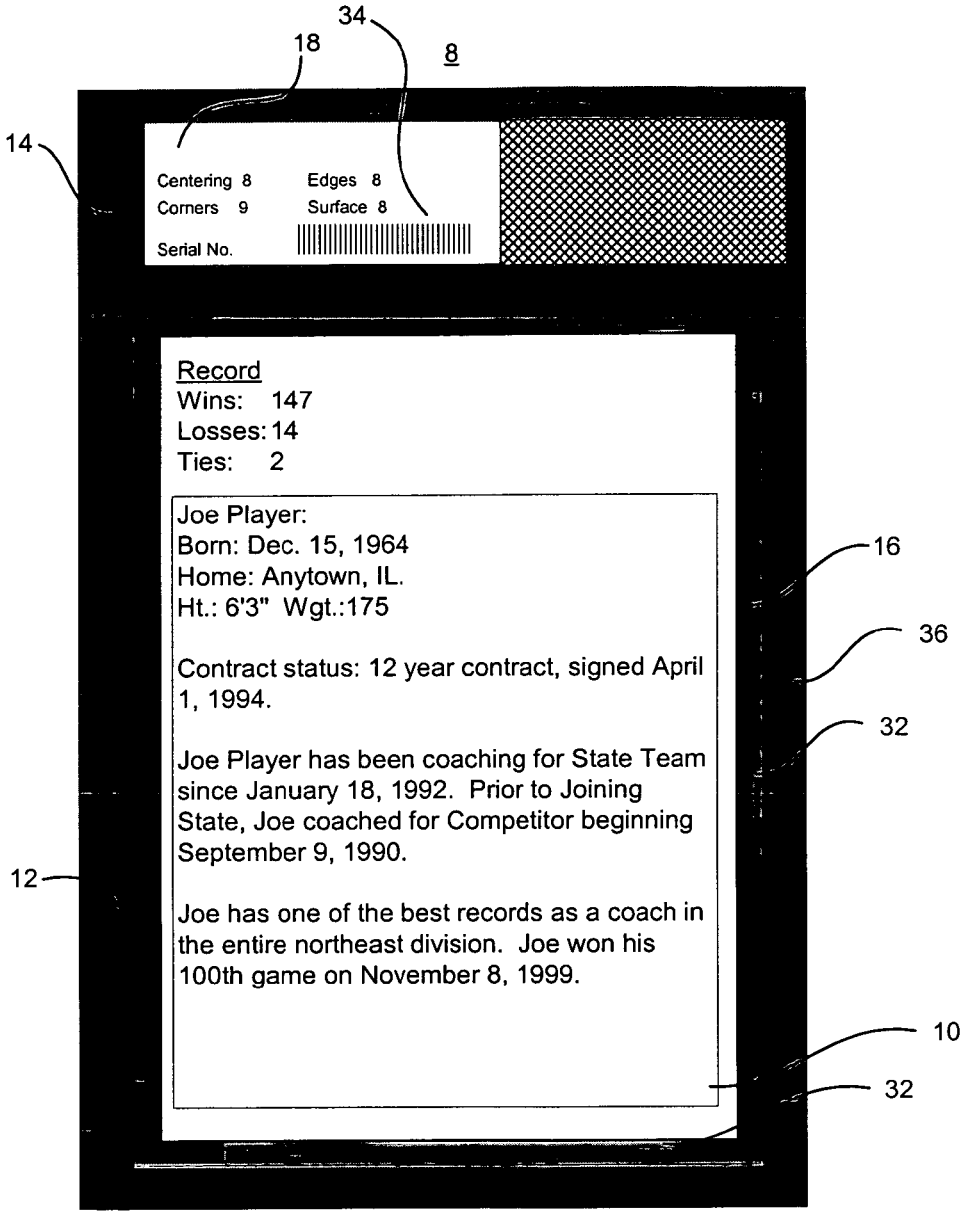
FIG. 2 illustrates a rear view of an embodiment of a memorabilia article in accordance with the invention.

FIG. 2 illustrates a rear view of a collection case 8 according to an embodiment of the invention. In one embodiment of the invention, identifier 34 is visible on the back of the grading report 18. The identifier may include a serial number, bar code, or the like. In one embodiment, the identifier 34 is further included in the front view of the collection case. The grading report 18 includes the grading details for trading card 10. The card is preferably graded on image centering, card cut, corner condition, edges, surface condition, post-production trimming, creases or folds and the like. In one embodiment, the piece of memorabilia 20 is visible from the back of the collection case 8.

The case 12 is preferably made from hard acrylic, Lucite, or the like and is substantially clear. In one embodiment, each face and edge of the encapsulated trading card 12 can be viewed through the case. Case 12 preferably has internal stays 32 to prevent the trading card 12 from moving.

Minimizing internal movement insures that case 12 does not damage the trading card 10. The case 12 is preferably designed such that it can be stacked for storage without scratching any viewing surface.

The case 12 consists of a front portion 34 and a rear portion 36. In one embodiment, the two portions 34, 36 lock together to encase and protect the trading card 12 and piece of memorabilia 20. Preferably, an inner sleeve is utilized to protect the trading card 10.

The piece of memorabilia 20 is preferably related to the trading card 10. For example, the piece of memorabilia 20 may be portion of the uniform worn by the player depicted on trading card 10, or a portion of ball or puck used by the player depicted on trading card 10 during a game. Other examples of suitable pieces of memorabilia 20 include, for example, pieces of a bat, jersey, uniform, flag, artificial turf, stadium equipment, outfit, hockey stick, ticket, glove, auto part, instrument or the like. For non-sports related trading cards, the pieces of memorabilia 20 may be, for example, a piece of a guitar pick or the like used by the entertainer depicted on the trading card. In a preferred embodiment, the piece of memorabilia 20 fits within a ⅝-inch square. Preferably, the piece of memorabilia 20 is purchased directly from the athlete or entertainer, an agent, or licensed memorabilia dealer to ensure authenticity.

Figure 3:
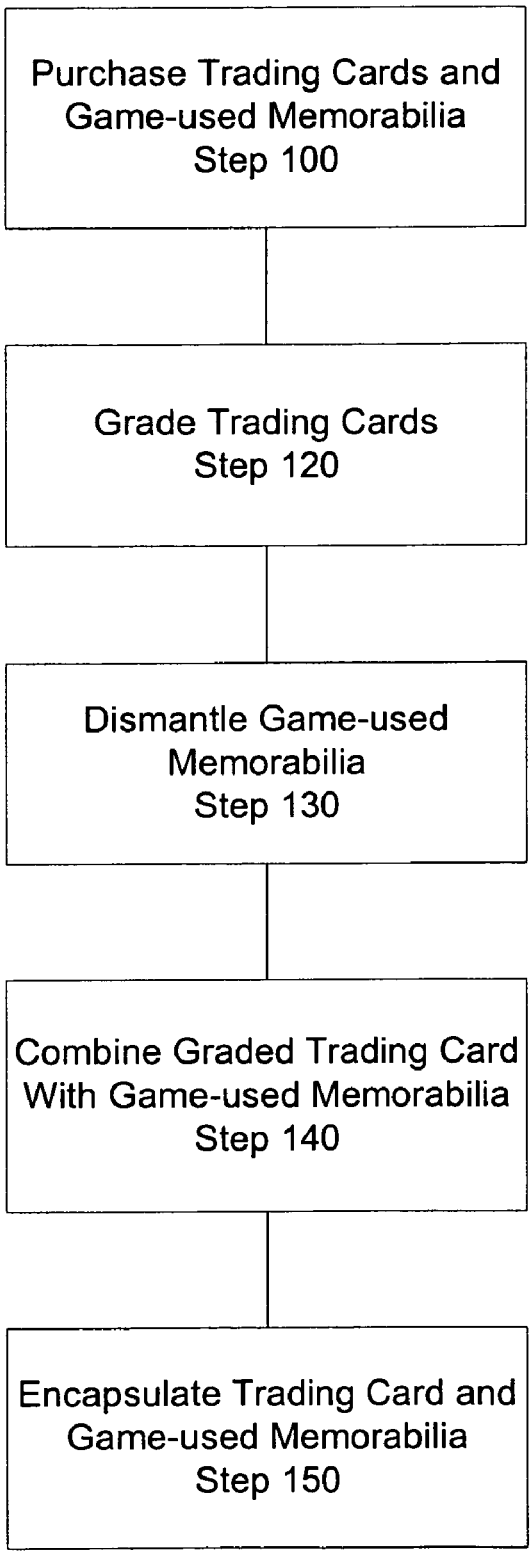
FIG. 3 is a flowchart illustrating steps for producing a memorabilia article in accordance with the invention.

In one embodiment, the collection case 8 is provided by a five-step process. As shown in FIG. 3, to produce the collection case 8, trading cards and associated memorabilia are purchased (step 100). The associated memorabilia is preferably a game or event related article, such as the bat used by the player on the trading card, the jersey worn by the player depicted on the card, a game ball used by the depicted player, or the like. In one embodiment of the invention, a certificate of authenticity accompanies the piece of memorabilia. Next, the trading cards are graded (step 120). Preferably, an independent grading company grades the trading cards. The trading cards are preferably graded on a scale from 1 to 10 in half-point increments, where 10 is the highest score. A report for each graded trading card is produced by the grading company. The associated memorabilia is divided or dismantled so that a piece of the associated memorabilia can be combined with the trading card (step 130). In one embodiment, an archival photograph of the associated memorabilia is taken before the memorabilia is divided into approximately ⅝-inch squares or pieces (step 130). Preferably, a certificate of authenticity accompanies each divided piece of the associated memorabilia. After the associated memorabilia is divided into smaller pieces, individual pieces are combined with its associated trading cards (step 140). The trading card and piece of memorabilia are encapsulated in a case. In one embodiment, a grading report is encapsulated together with the trading card and piece of memorabilia in a hard acrylic case, which is sonically sealed and assigned a bar code or other serial number. The bar code or other serial number is preferably used for registration purposes. Preferably, a certificate of authenticity accompanies the encapsulated product to authenticate at least the graded trading card. In one embodiment, the certificate of authenticity for the divided portion of the game-used memorabilia also accompanies the encapsulated product.

The collection case 8 is manufactured using a trading card 10 and piece of memorabilia 20 desirable to consumers. Trends in the memorabilia industry and consumer feedback are used to determine the collection cases to be produced. Preferably, the collection cases 8 are produced in specific series. A series of collection cases will may be identified by sport, release date, roster of athletes, memorabilia type, and the like.

As noted above, various criteria are considered when grading a trading card. For example, the criteria may include the edges of the card, the centering of the printing on the card, the corners of the card and the surface of the card. The grading criteria employed in one embodiment of the invention are presented in APPENDIX A. Half grades combine features of the grade above and below the actual half grade given to a particular trading card. Other grading considerations include combining aspects from specific grades to create a hybrid grade.

A collection case 8 (FIGS. 1, 2) can be extremely valuable. For a retailer to offer a high value collection case 8 to a consumer at an affordable price point, as well as derive multiple sales, a marketing technique is used called the "hidden purchase program." In one embodiment, each series of collection cases comprises a group of cases with different "book" values. In other words, each series contains a varying percentage of different valued cards, allowing the consumer the possibility to acquire a very expensive card at a low retail price. These cards, referred to as "chase" cards, are randomly inserted in the series. Since the retail packaging is sealed, and only lists the athletes in that series, the consumer does not know which athlete is in the package until purchasing and opening the package. In one embodiment, the odds of a specific card being in the package are printed on the package. Preferably, the retail packaging is opaque heat sealed Mylar. In one embodiment, an electronic article surveillance tag is embedded in the Mylar. Additionally, the collection case, which is in the Mylar heat-sealed package, is further sealed in a clear blister pack with a hangtag. Each series or production run has a specific number of production units. Each series is sport specific with a set number of chase cards. The effectiveness of this concept is evident in today's multi-million dollar trading card industry.

The collection case 8 is distributed through various marketing channels and are marketed for sale in retail stores, television or cable shopping channels, proprietary Internet websites, and/or third party Internet auction websites.

Although the present invention was discussed in terms of certain preferred embodiments, the invention is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. A collection case comprising:

a case having at least a first compartment and a separate second compartment;

a trading card located in said first compartment, said trading card depicting a sports player, said trading card having two faces and a plurality of edges, said card being positioned such that each face and edge of said card being visible through said case;

a piece of memorabilia in a second compartment, said memorabilia comprising a portion of an item which was utilized by said sports player in a sporting event; said case sealing said trading card and said memorabilia, said trading card and said memorabilia being visible through said case; and a grading report associated with said trading card, said case sealing said grading report, said grading report being visible through said case.

2. The collection case of claim 1, wherein said first compartment is located in a lower portion of the case and said second compartment is located in an upper portion of said case.

3. The collection case of claim 1, wherein said case is made from hard acrylic.

4. The collection ease of claim 1, wherein said grading report comprises at least one element selected from the group consisting of an overall grade associated with said trading card, subject matter of said trading card, a publishing year of said trading card, a publisher of said trading card, a series number of said trading card, a description of said memorabilia.

* * * * *